US010223988B2

(12) United States Patent
Hwang

(10) Patent No.: US 10,223,988 B2
(45) Date of Patent: Mar. 5, 2019

(54) DISPLAY APPARATUS AND METHOD OF DRIVING THE SAME

(71) Applicant: SAMSUNG DISPLAY CO., LTD., Yongin-si, Gyeonggi-do (KR)

(72) Inventor: Young-Soo Hwang, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 37 days.

(21) Appl. No.: 15/454,168

(22) Filed: Mar. 9, 2017

(65) Prior Publication Data

US 2017/0372670 A1 Dec. 28, 2017

(30) Foreign Application Priority Data

Jun. 27, 2016 (KR) ..... 10-2016-0080190

(51) Int. Cl.
*G09G 3/36* (2006.01)

(52) U.S. Cl.
CPC ..... *G09G 3/3614* (2013.01); *G09G 3/3648* (2013.01); *G09G 3/3688* (2013.01); *G09G 2300/0426* (2013.01); *G09G 2300/0452* (2013.01)

(58) Field of Classification Search
CPC ..... G09G 3/3614; G09G 3/3688; G09G 2300/0452; G09G 2320/043
See application file for complete search history.

(56) References Cited

U.S. PATENT DOCUMENTS

2006/0202927 A1* 9/2006 Lee ..... G02F 1/1368 345/88
2011/0102471 A1* 5/2011 Hsu ..... G09G 3/3614 345/690
2014/0300845 A1* 10/2014 Tamaki ..... G02F 1/133514 349/65
2016/0042679 A1 2/2016 Park
2016/0063959 A1 3/2016 Jung
2016/0086550 A1 3/2016 Shin et al.
2016/0087627 A1 3/2016 Jang
2016/0314736 A1* 10/2016 Sang ..... G09G 3/3607

FOREIGN PATENT DOCUMENTS

KR 10-1999-0080837 11/1999
KR 10-2004-0068735 8/2004
KR 10-2013-0028596 3/2013

* cited by examiner

*Primary Examiner* — Liliana Cerullo
(74) *Attorney, Agent, or Firm* — F. Chau & Associates, LLC

(57) ABSTRACT

A display apparatus includes a display panel configured to display an image, and including a plurality of gate lines extending in a first direction, a plurality of data lines extending in a second direction crossing the first direction, and a plurality of pixel units electrically connected to the gate lines and the data lines, a gate driving circuit configured to output a gate signal to each of the gate lines, and a data driving circuit configured to output data signals to the data lines using a column inversion method and a dot inversion method. In the column inversion method, polarities of the data signals, applied to first and second consecutive data lines, are inverted with respect to each other, and in the dot inversion method, polarities of the data signals applied to a third data line are inverted in pixel units arranged on opposite sides of the third data line.

18 Claims, 8 Drawing Sheets

DISPLAY APPARATUS AND METHOD OF DRIVING THE SAME

CROSS-REFERENCE TO RELATED APPLICATION

This application claims priority under 35 U.S.C. § 119 to Korean Patent Application No. 10-2016-0080190, filed on Jun. 27, 2016, in the Korean Intellectual Property Office (KIPO), the disclosure of which is incorporated by reference herein in its entirety.

TECHNICAL FIELD

The present invention relates to a display apparatus, and more particularly, to a display apparatus and a method of driving the display apparatus.

DISCUSSION OF THE RELATED ART

A display apparatus includes a display panel and a display panel driving apparatus.

The display panel includes a lower substrate, an upper substrate and a liquid crystal layer disposed between the upper and lower substrates. The lower substrate may include a first base substrate, a plurality of gate lines, a plurality of data lines, a plurality of thin film transistors and a plurality of pixel electrodes electrically connected to the thin film transistors, respectively. The upper substrate may include a second base substrate facing the first base substrate, a color filter and a common electrode. The arrangement of the liquid crystal molecules of the liquid crystal layer may be changed by an electric field generated between the pixel electrodes and the common electrode.

The display panel driving apparatus includes a gate driving part, a data driving part and a timing controlling part. The gate driving part outputs gate signals to the gate lines. The data driving part outputs data signals to the data line. The timing controlling part controls the timing of the gate driving part and the data driving part.

Each data line may be applied with a data signal having a positive polarity or a negative polarity. This may be done to prevent degradation of the liquid crystal.

SUMMARY

According to an exemplary embodiment of the present invention, a display apparatus includes a display panel configured to display an image, and including a plurality of gate lines extending in a first direction, a plurality of data lines extending in a second direction crossing the first direction, and a plurality of pixel units, wherein each pixel unit is electrically connected to one of the gate lines and one of the data lines, a gate driving circuit configured to output a gate signal to each of the gate lines, and a data driving circuit configured to output data signals to the data lines using a column inversion method and a dot inversion method. In the column inversion method, polarities of the data signals, applied to a first data line and a second data line adjacent to the first data line in the first direction, are inverted with respect to each other, and in the dot inversion method, polarities of the data signals applied to a third data line are inverted in pixel units arranged on opposite sides of the third data line in the second direction.

According to an exemplary embodiment of the present invention, a method of driving a display apparatus includes outputting a plurality of gate signals to a plurality of gate lines of a display panel, respectively, wherein the display panel displays an image and includes the plurality of gate lines extending in a first direction and a plurality of data lines extending in a second direction crossing the first direction, and outputting a plurality of data signals to the plurality of data lines, respectively, using a column inversion method or a dot inversion method. In the column inversion method, polarities of the data signals, applied to a first data line and a second data line adjacent to the first data line in the first direction, are inverted with respect to each other, and in the dot inversion method, polarities of the data signals applied to a third data line are inverted in sub pixels arranged on opposite sides of the third data line in the second direction.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
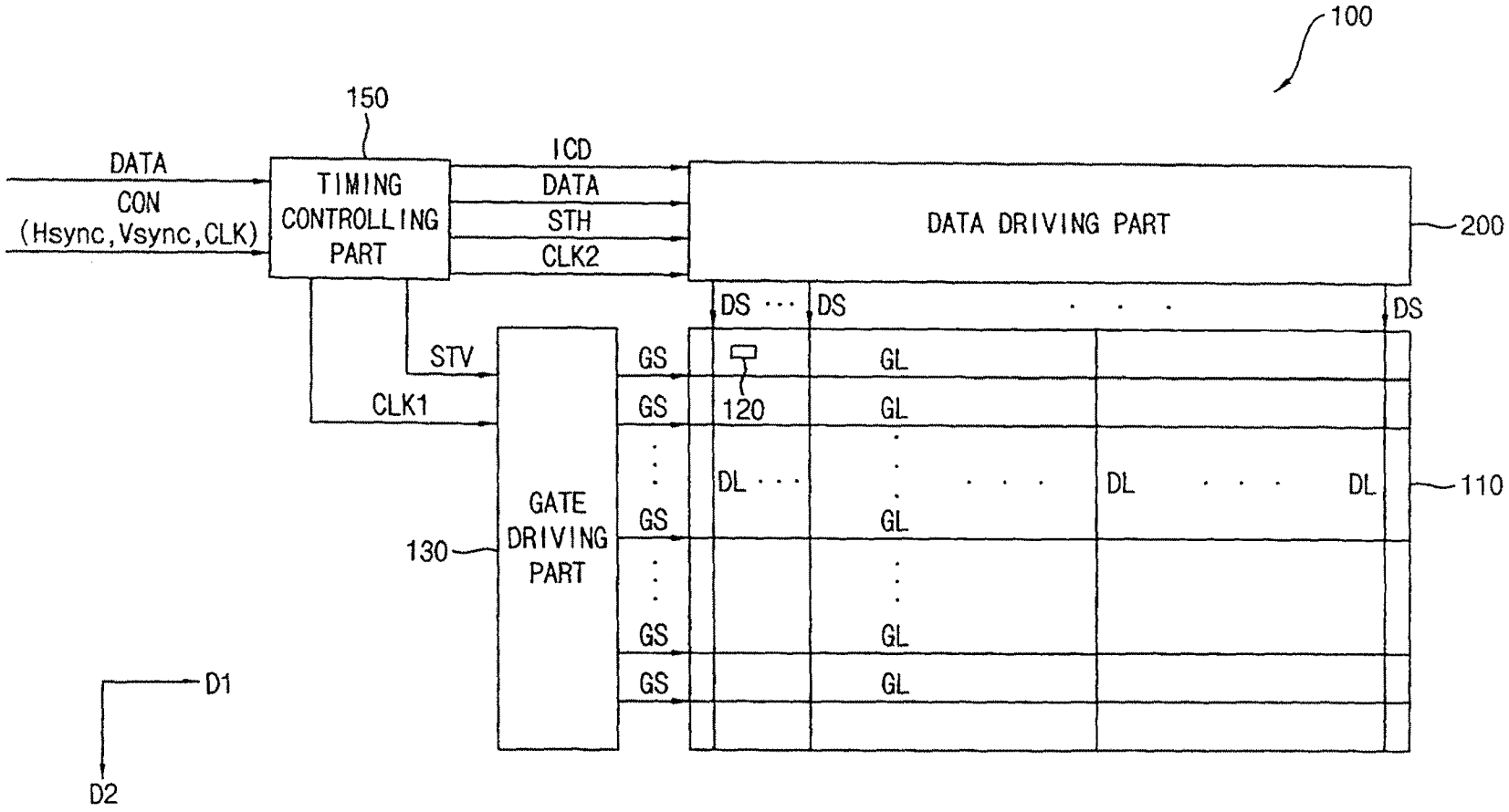
FIG. 1 is a block diagram illustrating a display apparatus according to an exemplary embodiment of the present invention.

Exemplary embodiments of the present invention will be described more fully hereinafter with reference to accompanying drawings. The present invention may, however, be embodied in different forms and should not be construed as limited to the embodiments set forth herein. Like reference numerals may refer to like elements throughout the specification. The sizes or proportions of elements illustrated in the drawings may be exaggerated for clarity.

FIG. 1 is a block diagram illustrating a display apparatus according to an exemplary embodiment of the present invention.

Referring to FIG. 1, the display apparatus 100 includes a display panel 110, a gate driving part 130 (e.g., a gate driving circuit 130), a data driving part 200 (e.g., a data driving circuit 200) and a timing controlling part 150 (e.g., a timing controlling circuit 150).

The display panel 110 receives a data signal DS from the data driving part 200 to display an image. The display panel 110 includes gate lines GL, data lines DL and pixel units 120. The gate lines GL extend in a first direction D1 and are spaced apart from each other in a second direction D2 substantially perpendicular to the first direction D1. The data lines DL extend in the second direction D2 and are spaced apart from each other in the first direction D1. The first direction D1 may be parallel to a long side of the display panel 110, and the second direction D2 may be parallel to a short side of the display panel 110.

Figure 2:
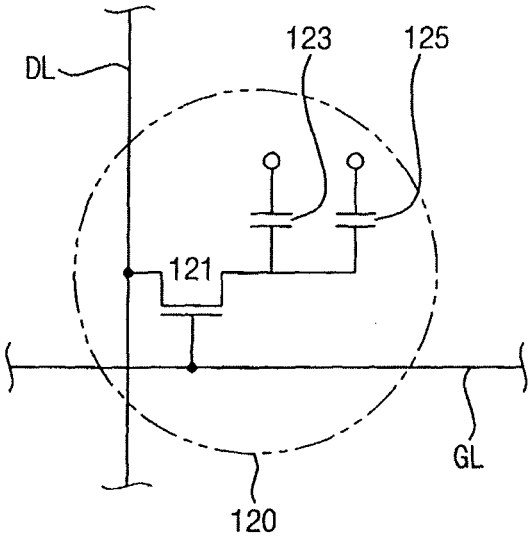
FIG. 2 is a circuit diagram illustrating a pixel unit of FIG. 1 according to an exemplary embodiment of the present invention.

FIG. 2 is a circuit diagram illustrating a pixel unit of FIG. 1 according to an exemplary embodiment of the present invention.

Referring to FIGS. 1 and 2, each of the pixel units 120 is disposed adjacent to an intersection of a gate line GL and a data line DL. For example, a pixel unit 120 may include a thin film transistor 121 electrically connected to a gate line GL and a data line DL, a liquid crystal capacitor 123 and a storage capacitor 125 connected to the thin film transistor 121. Thus, the display panel 110 may be a liquid crystal display panel.

Figure 3:
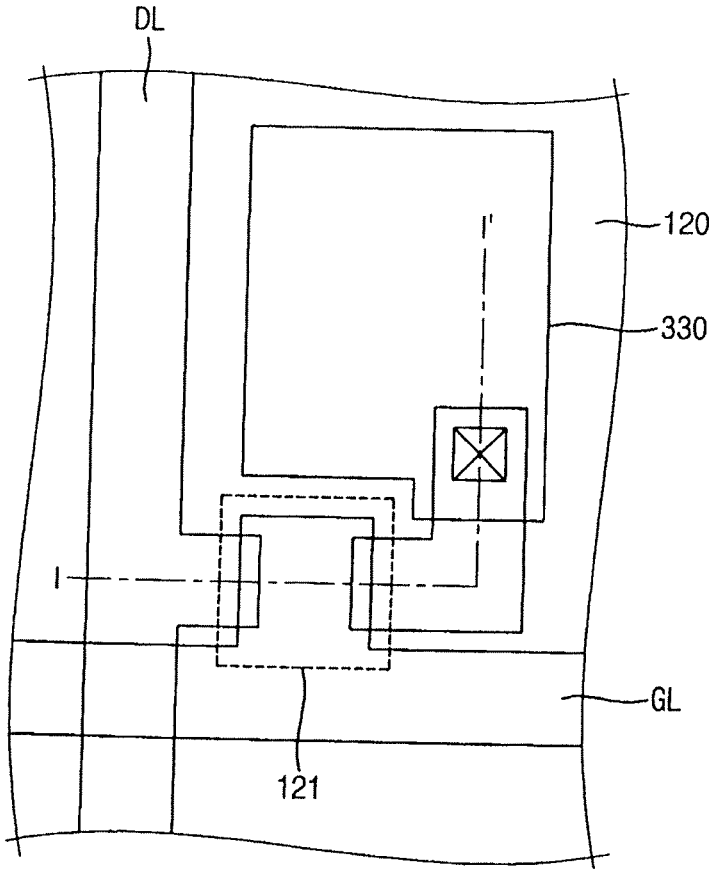
FIG. 3 is a plan view illustrating the pixel unit of FIGS. 1 and 2, according to an exemplary embodiment of the present invention.
Figure 4:
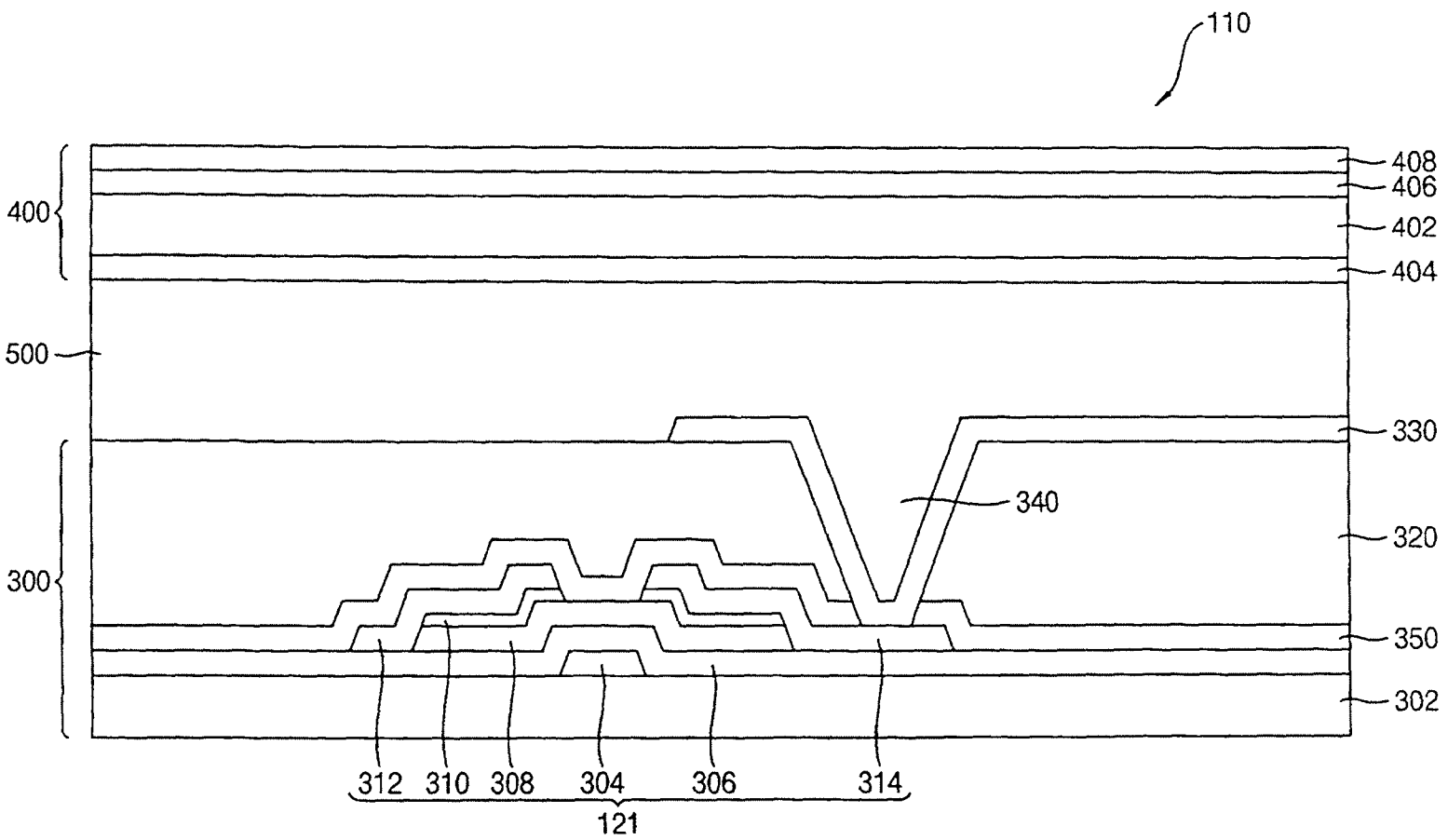
FIG. 4 is a cross-sectional view taken along a line I-I' of FIG. 3, according to an exemplary embodiment of the present invention.

FIG. 3 is a plan view illustrating the pixel unit 120 of FIGS. 1 and 2, according to an exemplary embodiment of the present invention. FIG. 4 is a cross-sectional view taken along a line I-I' of FIG. 3, according to an exemplary embodiment of the present invention.

Referring to FIGS. 1 to 4, the display panel 110 includes a lower substrate 300, an upper substrate 400 and a liquid crystal layer 500.

The lower substrate 300 may include a first base substrate 302, a thin film transistor 121 formed on the first base substrate 302, a color filter layer 320 formed on the thin film transistor 121, and a pixel electrode 330 formed on the color filter layer 320. The pixel electrode 330 may be electrically connected to a drain electrode 314 of the thin film transistor 121 through a contact hole formed in the color filter layer 320.

The thin film transistor 121 may include a gate electrode 304 formed on the first base substrate 302 and extended from the gate line GL, a gate insulating layer 306 formed on the gate electrode 304, an active layer 308 formed on the gate insulating layer 306, an ohmic-contact layer 310 formed on the active layer 308, a source electrode 312 formed on the ohmic-contact layer 310 and extended from the data line DL, and a drain electrode 314 formed on the ohmic-contact layer 310 and spaced apart from the source electrode 312.

The lower substrate 330 may further include a reflection sheet 350. The reflection sheet 350 reflects external light from the outside of the display panel 110. The reflection sheet 350 may be formed between the thin film transistor 121 and the color filter layer 320. In addition, as shown in FIG. 4, the reflection sheet 350 may pass through an opening of the ohmic-contact layer 310.

The upper substrate 400 may include a second base substrate 402 facing the first base substrate 302, a common electrode 404 formed on a first surface of the second base substrate 402, a light control film 406 formed on a second surface opposite to the first surface of the second base substrate 402, and a polarizing plate 408 formed on the light control film 406. The light control film 406 may condense and control the light reflected from the reflection sheet 350. The polarizing plate 408 may polarize light.

The liquid crystal layer 500 is formed between the lower substrate 300 and the upper substrate 400, and includes a liquid crystal. An arrangement of the liquid crystal is changed by an electric field between the pixel electrode 330 and the common electrode 404.

Referring to FIG. 1, the gate driving part 130, the data driving part 200 and the timing controlling part 150 may be referred to as a display panel driving apparatus for driving the display panel 110.

The gate driving part 130 generates gate signals GS in response to a vertical start signal STV and a first clock signal CLK1 provided from the timing controlling part 150, and outputs the gate signals GS to the gate line GL.

The data driving part 200 receives image data DATA from the timing controlling part 150, generates the data signals DS based on the image data DATA, and outputs the data signals DS to the data lines DL in response to a horizontal start signal STH and a second clock signal CLK2 provided from the timing controlling part 150.

Figure 7:
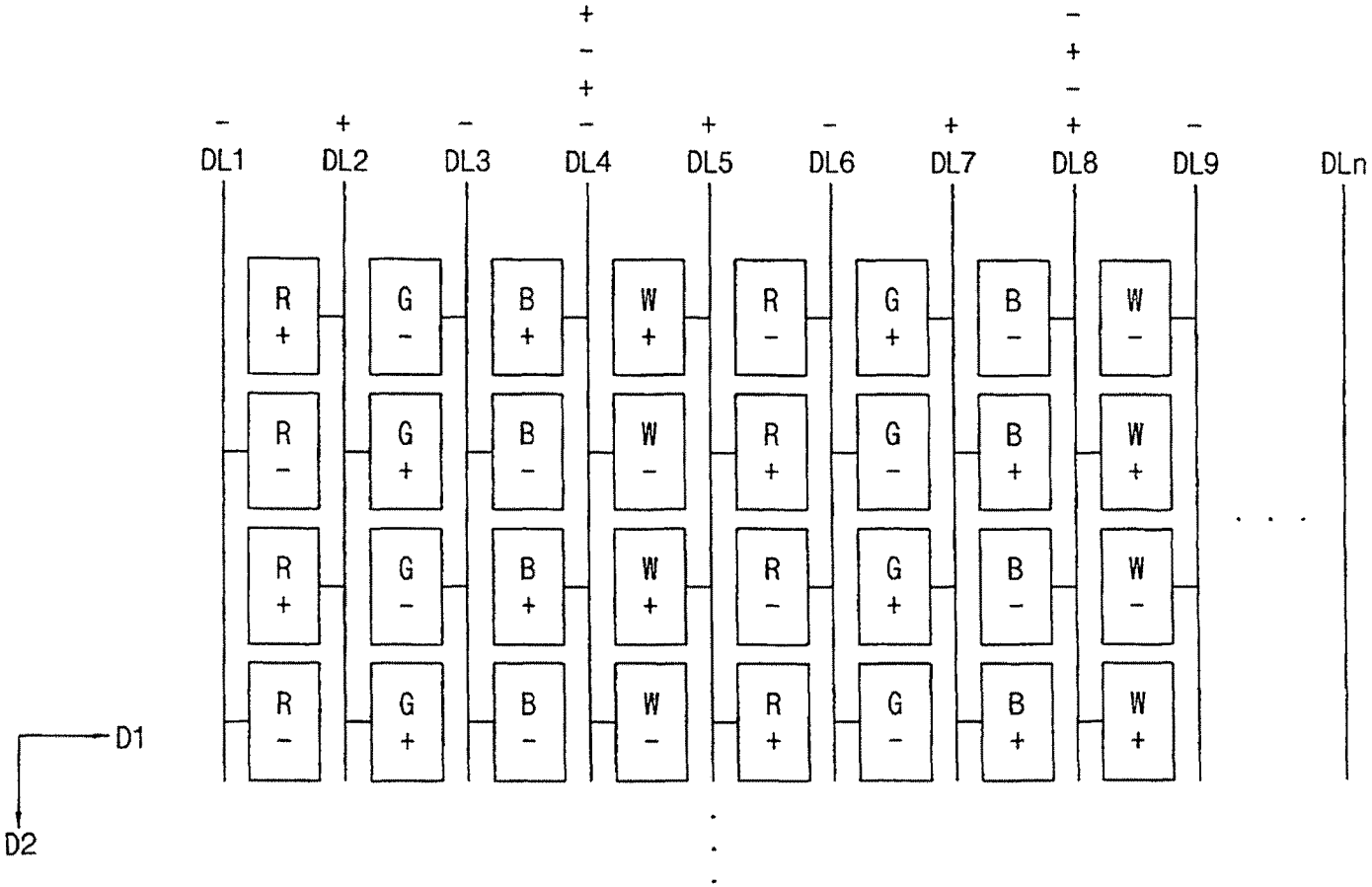
FIG. 7 is a diagram illustrating a column inversion method and a dot inversion method performed by the data driving part of FIGS. 1 and 6, according to an exemplary embodiment of the present invention.

The data driving part 200 outputs the data signals DS to the data lines DL, using a column inversion method, in which polarities of the data signals DS applied to the data lines DL arranged in the first direction D1 are inverted, and a dot inversion method, in which polarities of the data signal DS applied to the data line DL are inverted in pixel units 120 disposed on opposite sides of the data line DL in the second direction D2 (see FIG. 7). The data driving part 200 outputs the data signal DS to the data line DL using the column inversion method and the dot inversion method during one frame. For example, the data driving part 200 may drive some of the data lines DL in the column inversion method and may drive others of the data lines DL in the dot inversion method, during one frame. Thus, the data driving part 200 may individually drive the data lines DL in the column inversion method or the dot inversion method.

The timing controlling part 150 receives the image data DATA and a control signal CON from another circuit. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 200. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 200.

The timing controlling part 150 further outputs an inversion control data ICD to the data driving part 200. The inversion control data ICD is data for controlling an inversion method of the data driving part 200.

Figure 5:
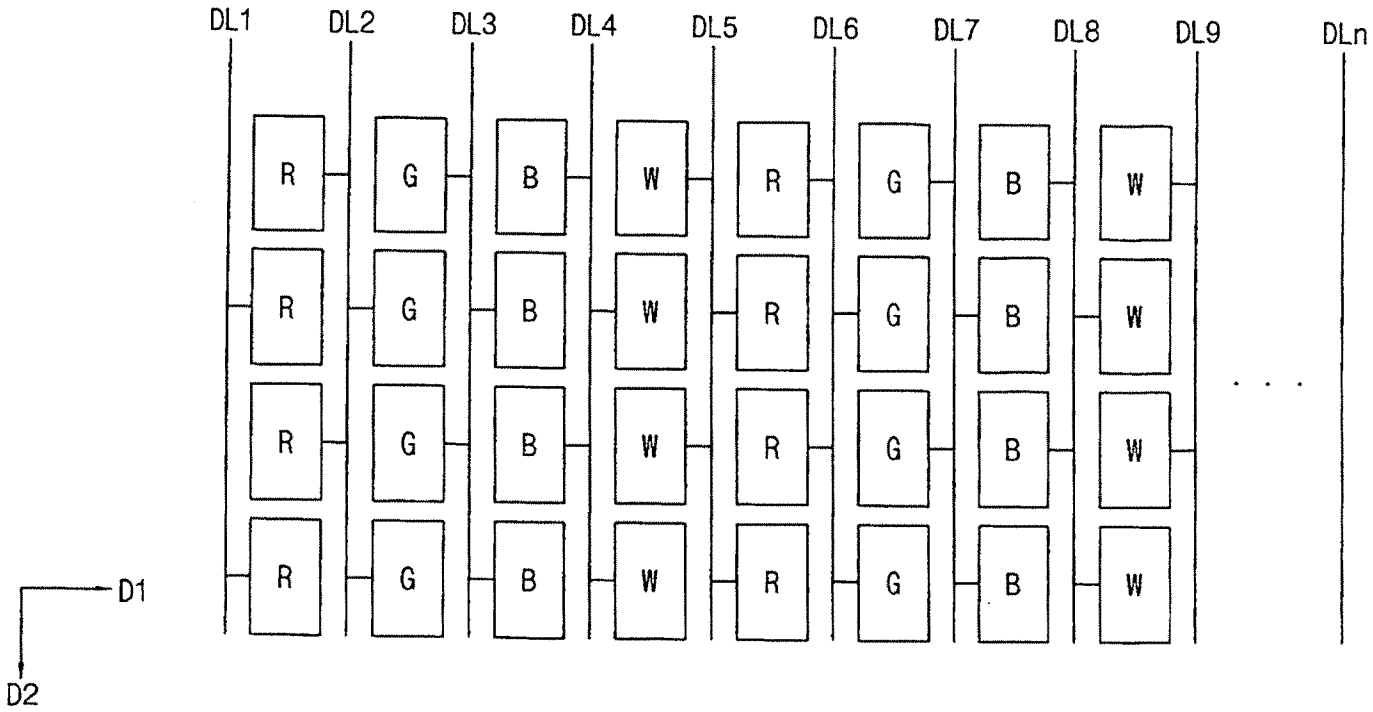
FIG. 5 is a plan view illustrating a display panel of FIG. 1 according to an exemplary embodiment of the present invention.

FIG. 5 is a plan view illustrating the display panel 110 of FIG. 1 according to an exemplary embodiment of the present invention.

Referring to FIGS. 1 and 5, the data lines DL may include first to n-th data lines DL1, DL2, . . . , DL9, . . . , and DLn.

A pixel unit 120 may include a red sub pixel R, a green sub pixel G, a blue sub pixel B and/or a white sub pixel W. The red sub pixel R, the green sub pixel G, the blue sub pixel B and the white sub pixel W may be repeatedly disposed in a sequence of the red sub pixel R, the green sub pixel G, the blue sub pixel B and the white sub pixel W in the first direction D1. In addition, each of the red sub pixel R, the green sub pixel G, the blue sub pixel B and the white sub pixel W may be repeatedly disposed in the second direction D2.

A data line DL is alternately connected to pixel units 120 disposed both sides of the data line DL. For example, the second data line DL2 may be alternately connected to red sub pixels R and green sub pixels G in the second direction D2.

Figure 6:
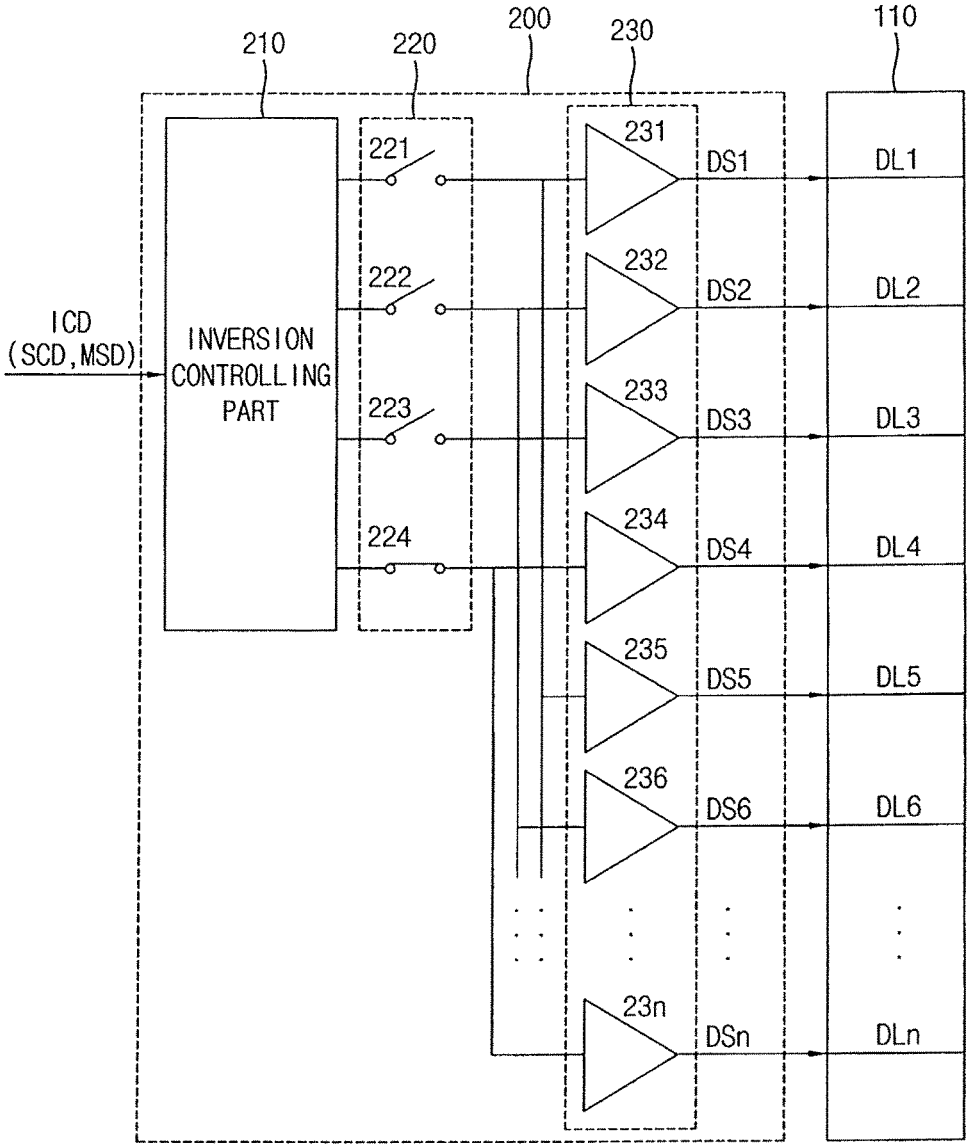
FIG. 6 is a block diagram illustrating the display panel and a data driving part of FIG. 1 according to an exemplary embodiment of the present invention.

FIG. 6 is a block diagram illustrating the display panel 110 and the data driving part 200 of FIG. 1 according to an exemplary embodiment of the present invention.

Referring to FIGS. 1, 5 and 6, the display panel 110 includes the first to n-th data lines DL1, DL2, . . . , and DLn.

The data driving part 200 includes an inversion controlling part 210 (e.g., an inversion controlling circuit 210), a switch part 220 (e.g., a switch circuit 220) and a buffer part 230 (e.g., a buffer circuit 230).

The buffer part 230 includes first to n-th buffers 231, 232, . . . , and 23*n* for outputting first to n-th data signals DS1, DS2, . . . , and DSn to the first to n-th data lines DL1, DL2, . . . , and DLn, respectively.

The inversion controlling part 210 receives the inversion control data ICD from the timing controlling part 150, and controls the switch part 220 according to switch control data SCD included in the inversion control data ICD.

The switch part 220 may include a first switch 221, a second switch 222, a third switch 223 and a fourth switch 224. The number of the switches in the switch part 220 may be the same as the number of the sub pixels included in a pixel unit 120. In an exemplary embodiment of the present invention, since each of the pixel units 120 includes four sub pixels R, G, B and W, the number of the switches in the switch part 220 may be four.

The first switch 221, the second switch 222, the third switch 223 and the fourth switch 224 are controlled according to the switch control data SCD in the inversion control data ICD. The switch control data SCD opens three switches of the first switch 221, the second switch 222, the third switch 223 and the fourth switch 224, and closes one switch of the first switch 221, the second switch 222, the third switch 223 and the fourth switch 224. To close one switch of the first switch 221, the second switch 222, the third switch 223 and the fourth switch 224, the switch control data SCD may be two bit data. For example, when a value of the switch control data SCD is '11', only the fourth switch 224 may be closed among the first switch 221, the second switch 222, the third switch 223 and the fourth switch 224. Alternatively, to independently control an opening and closing of the first switch 221, an opening and closing of the second switch 222, an opening and closing of the third switch 223, and an opening and closing of the fourth switch 224, the switch control data SCD may be four bit data.

The first switch 221, the second switch 222, the third switch 223 and the fourth switch 224 are connected to all data lines DL.

For example, the first switch 221 is connected to the first data line DL1, and to data lines spaced apart from the first data line DL1 at every four sub pixel interval in the first direction D1. Thus, when the first data line DL1 is defined as a K-th (K is a positive natural number) data line, the first switch 221 is connected to the K-th data line, and to data lines spaced apart from the K-th data line at every four sub pixel interval in the first direction D1.

In addition, the second switch 222 is connected to the second data line DL2, and to data lines spaced apart from the second data line DL2 every four sub pixel interval in the first direction D1. Thus, when the second data line DL2 is defined as a (K+1)-th data line, the second switch 222 is connected to the (K+1)-th data line, and to data lines spaced apart from the (K+1)-th data line at every four sub pixel interval in the first direction D1.

In addition, the third switch 223 is connected to the third data line DL3, and to data lines spaced apart from the third data line DL3 every four sub pixel interval in the first direction D1. Thus, when the third data line DL3 is defined as a (K+2)-th data line, the third switch 223 is connected to the (K+2)-th data line, and to data lines spaced apart from the (K+2)-th data line at every four sub pixel interval in the first direction D1.

In addition, the fourth switch 224 is connected to the fourth data line DL4, and to data lines spaced apart from the fourth data line DL4 every four sub pixel interval in the first direction D1. Thus, when the fourth data line DL4 is defined as a (K+3)-th data line, the fourth switch 224 is connected to the (K+3)-th data line, and to data lines spaced apart from the (K+3)-th data line at every four sub pixel interval in the first direction D1.

When a switch in the switch part 220 is opened, the data driving part 200 may drive the data lines DL connected to the opened switch in the column inversion method, and when a switch in the switch part 220 is closed, the data driving part 200 may drive the data lines DL connected to the closed switch in the dot inversion method. In an exemplary embodiment of the present invention, when a switch in the switch part 220 is opened, the data driving part 200 drives the data lines DL connected to the opened switch in the column inversion method, and when a switch in the switch part 220 is closed, the data driving part 200 drives the data lines DL connected to the closed switch in the dot inversion method. However, the present invention is not limited thereto. For example, when a switch in the switch part 220 is opened, the data driving part 200 may drive the data lines DL connected to the opened switch in the dot inversion method, and when a switch in the switch part 220 is closed, the data driving part 200 may drive the data lines DL connected to the closed switch in the column inversion method.

The inversion control data ICD, applied to the inversion controlling part 210, may further include a method selection data MSD. The method selection data MSD is data for determining whether a mixed inversion method, including the column inversion method and the dot inversion method, is selected or not. The method selection data MSD may be one bit data. For example, when a value of the method selection data MSD is '1', the data driving part 200 may select the mixed inversion method including the column inversion method and the dot inversion method.

FIG. 7 is a diagram illustrating a column inversion method and a dot inversion method performed by the data driving part 200 of FIGS. 1 and 6, according to an exemplary embodiment of the present invention.

Referring to FIGS. 1 and 5 to 7, the data driving part 200 outputs the data signals DS to the data lines DL1, DL2, . . . , DL9, . . . , and DLn using the column inversion method and the dot inversion method during one frame.

For example, the data driving part 200 outputs the data signals DS to the data lines DL1, DL2, . . . , DL9, . . . , and DLn using a mixed inversion method in which the data driving part 200 drives three consecutive data lines, of a group of four successive data lines of the data lines DL1 to DLn, in the column inversion method, and drives the remaining one data line, of the group of four successive data lines of the data lines DL1 to DLn, in the dot inversion method. In addition, the data driving part 200 outputs the data signals DS to the data lines DL1, DL2, . . . , DL9, . . . , and DLn by repeating the mixed inversion method at every four data lines in the first direction D1.

For example, the data driving part 200 may drive the first data line DL1, the second data line DL2 and the third data line DL3 in the column inversion method, and may drive the fourth data line DL4 in the dot inversion method. In addition, the data driving part 200 may drive the fifth data line DL5, the sixth data line DL6 and the seventh data line DL7 in the column inversion method, and may drive the eighth data line DL8 in the dot inversion method.

For example, the data driving part 200 may output a data signal DS having a negative polarity to the first data line DL1, may output a data signal DS having a positive polarity to the second data line DL2, may output a data signal DS having a negative polarity to the third data line DL3, and may sequentially output a data signal DS having a positive polarity, a data signal DS having a negative polarity, a data signal DS having a positive polarity and a data signal DS having a negative polarity to the fourth data line DL4. In addition, the data driving part 200 may output a data signal DS having a positive polarity to the fifth data line DL5, may output a data signal DS having a negative polarity to the sixth data line DL6, may output a data signal DS having a positive polarity to the seventh data line DL7, and may sequentially output a data signal DS having a negative polarity, a data signal DS having a positive polarity, a data signal DS having a negative polarity and a data signal DS having a positive polarity to the eighth data line DL8.

Therefore, the data driving part 200 may drive the K-th data line, the (K+1)-th data line and the (K+2)-th data line, among the data lines DL, in the column inversion method, and may drive the (K+3)-th data line, among the data lines DL, in the dot inversion method. In addition, the data driving part 200 may repeat the mixed inversion method including the column inversion method and the dot inversion method at every four data lines in the first direction D1.

Accordingly, polarities of data voltages charged in the red sub pixel R, the green sub pixel G, the blue sub pixel B and the white sub pixel W are inverted in a pixel unit 120 in the first direction D1 and in a pixel unit 120 in the second direction D2, with respect to the same sub pixel R, G, B or W. Thus, a degradation of the liquid crystal in the display panel 110 may be reduced or prevented. Therefore, the display quality of the display apparatus 100 may be increased.

Figure 8:
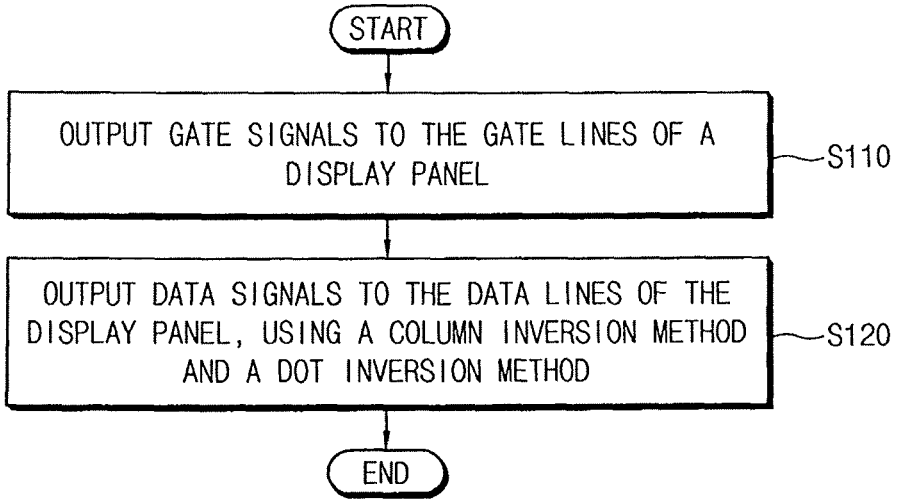
FIG. 8 is a flow chart illustrating a method of driving the display apparatus of FIG. 1 according to an exemplary embodiment of the present invention.

FIG. 8 is a flow chart illustrating a method of driving the display apparatus 100 of FIG. 1 according to an exemplary embodiment of the present invention.

Referring to FIGS. 1 and 5 to 8, the gate signal GS is output to the gate lines GL of the display panel 110 (step S110). For example, the gate driving part 130 generates the gate signals GS in response to the vertical start signal STV and the first clock signal CLK1 provided from the timing controlling part 150, and the gate driving part 130 outputs the gate signals GS to the gate lines GL.

The data signals DS are output to the data lines DL of the display panel 110 using the column inversion method and the dot inversion method (step S120).

For example, the data driving part 200 receives the image data DATA from the timing controlling part 150. The data driving part 200 generates the data signal DS based on the image data DATA, and outputs the data signals DS to the data lines DL in response to the horizontal start signal STH and the second clock signal CLK2, provided from the timing controlling part 150.

The data driving part 200 outputs the data signals DS to the data lines DL using the column inversion method, in which the polarities of the data signals DS applied to the data lines DL arranged in the first direction D1 are inverted, and the dot inversion method, in which the polarities of the data signal DS applied to the data line DL are inverted in pixel units 120 disposed on opposite sides of the data line DL in the second direction D2 (see FIG. 7). The data driving part 200 outputs the data signals DS to the data lines DL using the column inversion method and the dot inversion method during one frame. For example, the data driving part 200 may drive some of the data lines DL in the column inversion method and may drive others of the data lines DL in the dot inversion method, during one frame. Thus, the data driving part 200 may individually drive the data lines DL in the column inversion method or the dot inversion method.

The data driving part 200 outputs the data signals DS to the data lines DL1, DL2, . . . , DL9, . . . , and DLn using the column inversion method and the dot inversion method during one frame.

The data driving part 200 outputs the data signals DS to the data lines DL1, DL2, . . . , DL9, . . . , and DLn using the mixed inversion method, in which the data driving part 200 drives three consecutive data lines DL of a group of four consecutive data lines DL in the column inversion method and drives the fourth data line DL of the group of four consecutive data lines DL in the dot inversion method among. In addition, the data driving part 200 outputs the data signals DS to the data lines DL1, DL2, . . . , DL9, . . . , and DLn by repeating the mixed inversion method at every four data lines in the first direction D1.

For example, the data driving part 200 may drive the first data line DL1, the second data line DL2 and the third data line DL3 in the column inversion method, and may drive the fourth data line DL4 in the dot inversion method. In addition, the data driving part 200 may drive the fifth data line DL5, the sixth data line DL6 and the seventh data line DL7 in the column inversion method, and may drive the eighth data line DL8 in the dot inversion method.

For example, the data driving part 200 may output a data signal DS having a negative polarity to the first data line DL1, may output a data signal DS having a positive polarity to the second data line DL2, may output a data signal DS having a negative polarity to the third data line DL3, and may sequentially output a data signal DS having a positive polarity, a data signal DS having a negative polarity, a data signal DS having a positive polarity and a data signal DS having a negative polarity to the fourth data line DL4. In addition, the data driving part 200 may output a data signal DS having a positive polarity to the fifth data line DL5, may output a data signal DS having a negative polarity to the sixth data line DL6, may output a data signal DS having a positive polarity to the seventh data line DL7, and may sequentially output a data signal DS having a negative polarity, a data signal DS having a positive polarity, a data signal DS having a negative polarity and a data signal DS having a positive polarity to the eighth data line DL8.

Therefore, the data driving part 200 may drive the K-th data line, the (K+1)-th data line and the (K+2)-th data line, among the data lines DL, in the column inversion method, and may drive the (K+3)-th data line, among the data lines DL, in the dot inversion method. In addition, the data driving part 200 may repeat the mixed inversion method including the column inversion method and the dot inversion method at every four data lines in the first direction D1.

According to an exemplary embodiment of the present invention, the polarities of the data voltages charged in the red sub pixel R, the green sub pixel G, the blue sub pixel B and the white sub pixel W are inverted in a pixel unit 120 in the first direction D1 and in a pixel unit 120 in the second direction D2, with respect to the same sub pixel R, G, B or W. Thus, a degradation of the liquid crystal in the display panel 110 may be reduced or prevented. Therefore, the display quality of the display apparatus 100 may be increased.

The present invention may be applied to an electronic device having a display apparatus. For example, the present invention may be applied to a television, a computer monitor, a laptop, a digital camera, a cellular phone, a smart phone, a tablet Personal Computer (PC), a smart pad, a Personal Digital Assistant (PDA), a Portable Multimedia Player (PMP), an MPEG Audio Layer III (MP3) player, a navigation system, a camcorder, a portable game console, etc.

While the present invention has been particularly shown and described with reference to exemplary embodiments thereof, it will be apparent to those of ordinary skill in the art that various changes in form and detail may be made therein without departing from the spirit and scope of the present invention as defined by the following claims.

What is claimed is:

1. A display apparatus, comprising:

a display panel configured to display an image, and including a plurality of gate lines extending in a first direction, a plurality of data lines extending in a second direction crossing the first direction, and a plurality of pixel units, wherein each pixel unit is electrically connected to one of the gate lines and one of the data lines;

a gate driving circuit configured to output a gate signal to each of the gate lines; and a data driving circuit configured to output data signals to the data lines using a column inversion method and a dot inversion method, wherein, in the column inversion method, polarities of the data signals, applied to a first data line and a second data line adjacent to the first data line in the first direction, are inverted with respect to each other, and in the dot inversion method, polarities of the data signals applied to a third data line are inverted in pixel units arranged on opposite sides of the third data line in the second direction; and wherein, for at least two values of a positive integer K, the data driving circuit drives a K-th data line, a (K+1)-th data line and a (K+2)-th data line of the plurality of data lines in the column inversion method, and drives a (K+3)-th data line of the data lines in the dot inversion method.

2. The display apparatus of claim 1, wherein, for at least two values of the positive integer K that are separated by a value of 4, the data driving circuit drives a K-th data line, a (K+1)-th data line and a (K+2)-th data line of the plurality of data lines in the column inversion method, and drives a (K+3)-th data line of the data lines in the dot inversion method.

3. The display apparatus of claim 1, wherein, when the plurality of data lines includes a plurality of consecutive groups of data lines, and a first group of the plurality of consecutive groups of data lines includes four consecutive data lines, the data driving circuit drives three data lines in the column inversion method and one data line in the dot inversion method in the first group of four consecutive data lines.

4. The display apparatus of claim 1, wherein the data driving circuit comprises:

an inversion controlling circuit configured to control the column inversion method and the dot inversion method; and a plurality of switches which are opened and closed by the inversion controlling circuit.

5. The display apparatus of claim 4, wherein at least one of the pixel units comprises four sub pixels, and the data driving circuit includes four switches.

6. The display apparatus of claim 5, wherein the four switches are electrically connected to all of the plurality of data lines.

7. The display apparatus of claim 6, wherein the four switches comprise:

a first switch electrically connected to a K-th data line and to data lines spaced apart from the K-th data line by an interval of every four sub pixels in the first direction;

a second switch electrically connected to a (K+1)-th data line and to data lines spaced apart from the (K+1)-th data line by an interval of every four sub pixels in the first direction;

a third switch electrically connected to a (K+2)-th data line and to data lines spaced apart from the (K+2)-th data line by an interval of every four sub pixels in the first direction; and a fourth switch electrically connected to a (K+3)-th data line and to data lines spaced apart from the (K+3)-th data line by an interval of every four sub pixels in the first direction.

8. The display apparatus of claim 5, further comprising:

a timing controlling circuit configured to control a timing of the gate signal and a timing of the data signal, and to output inversion control data for controlling the column inversion method and the dot inversion method of the inversion controlling circuit.

9. The display apparatus of claim 8, wherein the inversion control data includes method selection data for determining whether a mixed inversion method including the column inversion method and the dot inversion method is selected or not, and wherein the method selection data is one bit data.

10. The display apparatus of claim 4, wherein, when a first switch of the plurality of switches is open, a first data line of the plurality of data lines connected to the opened first switch is driven in the column inversion method, and when the first switch is closed, the first data line connected to the closed first switch is driven in the dot inversion method.

11. The display apparatus of claim 1, wherein the display panel comprises:

a first substrate comprising a first base substrate, a thin film transistor disposed on the first base substrate, a color filter layer disposed on the thin film transistor, a pixel electrode disposed on the color filter layer and electrically connected to a drain electrode of the thin film transistor, and a reflection sheet disposed between the thin film transistor and the color filter layer and configured to reflect external light;

a second substrate comprising a second base substrate facing the first base substrate, a common electrode disposed on a first surface of the second base substrate, and a light control film disposed on a second surface opposite to the first surface of the second base substrate; and a liquid crystal layer disposed between the first substrate and the second substrate.

12. The display apparatus of claim 1, wherein at least one of the pixel units includes a red sub pixel, a green sub pixel, a blue sub pixel and a white sub pixel.

13. The display apparatus of claim 1, wherein a data line of the plurality of data lines is alternately connected to the pixel units disposed on both sides of the data line.

14. The display apparatus of claim 1, wherein the data driving circuit individually drives the data lines in the column inversion method or the dot inversion method.

15. A display apparatus, comprising:

a display panel configured to display an image, and including a plurality of gate lines extending in a first direction, a plurality of data lines extending in a second direction crossing the first direction, and a plurality of pixels units, wherein each pixel unit is electrically connected to one of the gate lines and one of the data lines;

a gate driving circuit configured to output a gate signal to each of the gate lines;

a data driving circuit configured to output data signals to the data lines using a column inversion method and a dot inversion method, wherein, in the column inversion method, polarities of the data signals, applied to a first data line and a second data line adjacent to the first data line in the first direction, are inverted with respect to each other, and in the dot inversion method, polarities of the data signals applied to a third data line are inverted in pixel units arranged on opposite sides of the third data line in the second direction;

wherein the data driving circuit comprises an inversion controlling circuit configured to control the column inversion method and the dot inversion method, and a plurality of switches which are opened and closed by the inversion controlling circuit;

wherein at least one of the pixel units comprises four sub pixels, and the data driving circuit includes four switches; and a timing controlling circuit configured to control a timing of the gate signal and a timing of the data signal, and to output inversion control data for controlling the column inversion method and the dot inversion method of the inversion controlling circuit, wherein the inversion control data includes switch control data for controlling an opening and closing of the four switches, and wherein the switch control data is two bit data.

16. A method of driving a display apparatus, the method comprising:

outputting a plurality of gate signals to a plurality of gate lines of a display panel, respectively, wherein the display panel displays an image and comprises the plurality of gate lines extending in a first direction and a plurality of data lines extending in a second direction crossing the first direction;

outputting a plurality of data signals to the plurality of data lines, respectively, using a column inversion method or a dot inversion method, wherein, in the column inversion method, polarities of the data signals, applied to a first data line and a second data line adjacent to the first data line in the first direction, are inverted with respect to each other, and in the dot inversion method, polarities of the data signals applied to a third data line are inverted in sub pixels arranged on opposite sides of the third data line in the second direction; and wherein, for at least two values of a positive integer K, the outputting of the plurality of data signals to the plurality line comprises, driving a K-th data line, a (K+1)-th data line and a (K+2)-th data line of the plurality of data lines in the column inversion method, and driving a (K+3)-th data line of the plurality of data lines in the dot inversion method.

17. The method of claim 16, wherein, for at least two values of the positive integer K that are separated by a value of 4, the outputting of the plurality of data signals to the plurality of data line comprises using a mixed inversion method, wherein the mixed inversion method comprises:

driving a K-th data line, a (K+1)-th data line and a (K+2)-th data line of the plurality of data lines in the column inversion method; and driving a (K+3)-th data line of the plurality of data lines in the dot inversion method.

18. A method of driving a display apparatus, the method comprising:

outputting a plurality of gate signals to a plurality of gate lines of a display panel, respectively, wherein the display panel displays an image and comprises the plurality of gate lines extending in a first direction and a plurality of data lines extending in a second direction crossing the first direction;

outputting a plurality of data signals to the plurality of data lines, respectively, using a column inversion method or a dot inversion method, wherein, in the column inversion method, polarities of data signals, applied to a first data line and a second data line adjacent to the first data line in the first direction, are inverted with respect to each other, and in the dot inversion method, polarities of the data signals applied to a third data line are inverted in sub pixels arranged on opposite sides of the third data line in the second direction;

wherein, when K is a positive integer, the outputting of the plurality of data signals to the plurality of data line comprises using a mixed inversion method, wherein the mixed inversion method comprises, driving a K-th data line, a (K+1)-th data line and a (K+2)-th data line of the plurality of data lines in the column inversion method, and driving a (K+3)-th data line of the plurality of data lines in the dot inversion method; and wherein outputting the data signals to the data lines comprises repeating the mixed inversion method every four data lines.

* * * * *